US005358131A

United States Patent [19]

McCandless et al.

[11] Patent Number: 5,358,131

[45] Date of Patent: Oct. 25, 1994

[54] TAMPER-INDICATING PLASTIC CLOSURE WITH SEGEMENTED PILFER BAND

[75] Inventors: Thomas McCandless; Michael E. Corcoran, both of Crawfordsville, Ind.

[73] Assignee: H-C Industries, Inc., Crawfordsville, Ind.

[21] Appl. No.: 61,829

[22] Filed: May 14, 1993

Related U.S. Application Data

[63] Continuation of Ser. No. 901,082, Jun. 19, 1992, abandoned.

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,196,818 | 4/1980 | Brownbill | 215/252 |
| 4,206,851 | 6/1980 | Ostrowsky | 215/246 |
| 4,305,516 | 12/1981 | Perne et al. | 215/252 |
| 4,346,811 | 8/1982 | Hilaire | 215/252 |
| 4,372,456 | 2/1983 | Guala | 215/252 |
| 4,418,828 | 12/1983 | Wilde et al. | 215/252 |
| 4,497,765 | 2/1985 | Wilde et al. | 264/268 |
| 4,573,601 | 3/1986 | Berglund | 215/252 |
| 4,548,329 | 10/1985 | Curry | 215/216 |
| 4,565,293 | 1/1986 | Jonas | 215/246 |
| 4,588,100 | 5/1986 | Itsubo et al. | 215/252 |
| 4,638,917 | 1/1987 | Persch | 215/252 |
| 4,664,279 | 5/1987 | Obrist et al. | 215/252 |
| 4,666,053 | 5/1987 | Corcoran et al. | 215/252 |
| 4,720,018 | 1/1988 | Schetzsle et al. | 215/252 |
| 4,796,770 | 1/1989 | Begley | 215/252 |
| 4,830,208 | 5/1989 | Osting et al. | 215/252 |
| 4,884,706 | 12/1989 | Julian | 215/252 |
| 4,986,430 | 1/1991 | Dutt | 215/253 |

*Primary Examiner*—Allan N. Shoap
*Assistant Examiner*—Nova Stucker
*Attorney, Agent, or Firm*—Dressler, Goldsmith, Shore, Sutker & Milnamow, Ltd.

[57] ABSTRACT

A tamper-indicating plastic closure includes an annular pilfer band which is partially detachably connected to a skirt portion of the closure, whereby the pilfer band remains connected to the closure after closure removal from an associated container. The pilfer band includes at least one fracturable region which fractures during closure removal, whereby the pilfer band splits and separates into a plurality of segments. Each segment is preferably dimensioned to facilitate its removal from an associated container by automatic washing equipment in the event that one of the segments is inserted into the container by a consumer.

7 Claims, 2 Drawing Sheets

TAMPER-INDICATING PLASTIC CLOSURE WITH SEGEMENTED PILFER BAND

This is a continuation of application Ser. No. 07/901,082 filed Jun. 19, 1992, now abandoned.

TECHNICAL FIELD

The present invention relates generally to a tamper-indicating plastic closure for use with an associated container, and more particularly to a tamper-indicating plastic closure having a partially detachable pilfer band configured to break into a plurality of segments, with the arrangement facilitating use of the closure on returnable and reusable containers.

BACKGROUND OF THE INVENTION

Tamper-indicating threaded plastic closures have found widespread acceptance in the marketplace for use on containers for beverages and food products, as well as for non-food items. One particularly commercially successful construction is disclosed in commonly-assigned U.S. Pat. No. 4,418,828, to Wilde et al., which closure can be efficiently formed in accordance with the teachings of U.S. Pat. No. 4,497,765, to Wilde et al. A modified form of this tamper-indicating closure is disclosed in U.S. Pat. No. 5,004,112, to McBride.

A tamper-indicating plastic closure embodying the teachings of the above patents includes an upper closure cap, and an annular pilfer band depending from a skirt portion of the closure cap. The pilfer band is either partially or completely detachably connected to the skirt portion by a series of circumferentially spaced frangible bridges. For those applications where it is desired that the pilfer band be completely detached from the closure cap during closure removal, the closure typically functions such that the annular pilfer band remains on the neck of the container. In contrast, for some applications, particularly in the case of returnable and reusable containers, it is desirable that the pilfer band be only partially detached from the closure cap attendant to closure removal, with the pilfer band remaining joined to the skirt portion of the cap. Use in this manner desirably avoids the need to remove the annular pilfer band from the container for its reuse.

For those applications where it is desired that the pilfer band remain connected to the closure cap after closure removal, closures of the type disclosed in the above-referenced patents include two particular features. First, the closure is provided with a connector portion which joins the pilfer band to the closure skirt after the frangible bridges fracture during closure removal so that the pilfer band is otherwise detached from the closure cap. Additionally, such closures include a fracturable region in the annular pilfer band itself, which region is typically positioned in the vicinity of the connector portion. By this arrangement, closure removal not only results in the desired partial separation of the pilfer band from the closure cap, but further results in splitting or fracture of the band itself, with the band assuming a curl-like configuration (sometimes referred to as a "pigtail").

Experience has shown that consumers sometimes separate and break the connector portion which joins the partially detached pilfer band to the closure cap, and rather than dispose of the now-separated pilfer band, insert it into the associated container. Unfortunately, this can undesirably inhibit efficient reuse of the container, since the dimensions of the typical pilfer band are such that it cannot be removed from the container by the usual automatic washing equipment.

SUMMARY OF THE INVENTION

A tamper-indicating plastic closure embodying the principles of the present invention includes a generally annular pilfer band which is configured to form a plurality of segments attendant to closure removal and fracture of the pilfer band. The pilfer band is configured such that none of the segments are of a size which cannot be removed from a container by automatic washing equipment. Thus, even in the event that a consumer detaches one or more of the segments from the closure cap, and inserts them into the container, the container can be easily and efficiently cleaned for reuse. Thus, a closure embodying the principles of the present invention is particularly suited for returnable and reusable containers, such as returnable glass containers.

In accordance with the illustrated embodiment, the present tamper-indicating plastic closure includes a closure cap having a top wall portion, and an annular skirt portion depending from the top wall portion. The skirt portion includes an internal thread formation configured for engagement with a like thread formation on an associated container.

The closure further includes an annular pilfer band partially detachably connected to the annular skirt portion by a plurality of circumferentially spaced frangible bridges. The pilfer band includes an annular band portion, inwardly from which extends a plurality of circumferentially spaced projections configured for cooperation with an annular locking ring on the neck of the associated container. The projections cooperate with the container locking ring during closure removal to fracture and break the frangible bridges, thereby partially detaching the pilfer band from the skirt portion of the closure.

In the preferred form, the frangible connection between the pilfer band and the closure skirt portion is provided by disposition of the frangible bridges on the inside surfaces of the skirt portion and the pilfer band, with the skirt portion and the pilfer band separated and distinguished from each other by a circumferential score line. The score line extends through the closure, and partially into the frangible bridges, whereby each of the frangible bridges defines a fracturable, unscored "residual" portion.

The pilfer band includes a single connector portion, preferably an unscored portion of the closure, which integrally connects the pilfer band to the skirt portion of the closure after fracture of the frangible bridges. The connector portion permits the pilfer band to be removed from the container together with the closure cap, with the connector portion typically exhibiting sufficient strength to permit reuse of the closure on the container (such as for resealing a partially emptied container) without complete detachment of the pilfer band.

In accordance with the present invention, the pilfer band further includes at least one fracturable portion, preferably provided in the form of a generally vertical scoring arrangement. The fracturable portion functions such that upon removal of the closure from the container and fracture of the frangible bridges, the fracturable portion fractures so that the pilfer band breaks into at least two pilfer band segments, each extending circumferentially from the connector portion at least 90° about the circumference of the closure.

In one illustrated embodiment, each of the pilfer band segments extends no greater than about 180° about the circumference of the closure, with the pilfer band segments being preferably of substantially equal length. By this arrangement, the fracturable region of the pilfer band is substantially diametrically opposed to the connector portion thereof.

In another illustrated embodiment, the pilfer band includes two spaced apart fracturable regions, each preferably comprising a generally vertical scoring arrangement. In this embodiment, the pilfer band includes another pilfer band segment extending between the pair of fracturable regions. Thus, two of the pilfer band portions each extend from the connector portion to a respective one of the fracturable regions, with the third pilfer band segment defined between the pair of fracturable regions.

As will be appreciated, it is desirable that the vertical scoring which preferably provides the fracturable regions of the pilfer band be arranged such that the pilfer band fractures and splits as intended. In this regard, the projections which extend from the inside surface of the pilfer band can sometimes undesirably prevent failure of the fracturable region if the vertical scoring which provides the region is substantially aligned with one of the projections. Accordingly, in the illustrated embodiment which includes two fracturable regions, the regions are circumferentially spaced from each other by a distance other than the relative spacing between any two of the pilfer band projections. This acts to assure that at least one of the pair of the fracturable regions will fracture as desired upon closure removal.

Such undesirable strengthening of one of the fracturable regions can also be avoided by angularly orienting the scoring which forms the fracturable region. Specifically, the present pilfer band can be configured such that the projections extending from the inward surface of the band each includes an edge portion integral with the annular band portion of the pilfer band, which edge portion extends at an acute angle relative to the vertical axis of the closure. The intended fracture of the pilfer band is facilitated by orienting the scoring which forms each fracturable region at the same acute angle relative to the vertical axis of the closure, whereby the scoring extends in a generally parallel orientation to the edge portions of adjacent ones of the inwardly extending projections.

Other features and advantages of the present invention will become readily apparent from the following detailed description, the accompanying drawings, and the appended claims.

DETAILED DESCRIPTION

Figure 1:
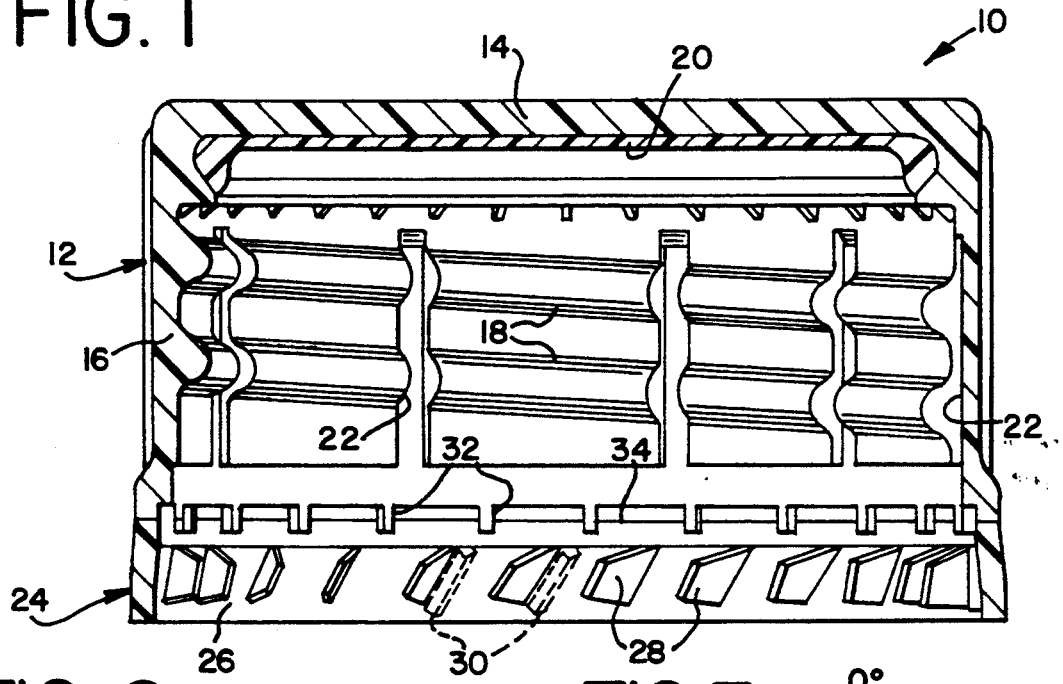
FIG. 1 is a cross-sectional view of a tamper-indicating plastic closure embodying the principles of the present invention.

While the present invention is susceptible of embodiment in various forms, there is shown in the drawings and will hereinafter be described presently preferred embodiments of the invention, with the understanding that the present disclosure is to be considered as an exemplification of the invention, and is not intended to limit the invention to the specific embodiments illustrated.

With reference to FIG. 1, therein is illustrated a tamper-indicating plastic closure 10 embodying the principles of the present invention. The closure 10 is illustrated in a configuration particularly suited for use on threaded containers, and more particularly, containers having carbonated or otherwise pressurized contents. Closures of this nature can be efficiently formed in accordance with the teachings of U.S. Pat. No. 4,497,765, hereby incorporated by reference.

Closure 10 includes an upper, generally cup-shaped closure cap 12 including a top wall portion 14, and an annular skirt portion 16 depending from the top wall portion. The skirt portion 16 includes an internal thread formation 18 configured for removable, threaded engagement with a like thread formation on an associated container.

In order to enhance the sealing engagement of the closure with an associated container, the illustrated embodiment includes a generally disc-shaped sealing liner 20, which in the illustrated embodiment, is configured for forming a top/side seal with an associated container. When used on a container having carbonated contents, it is preferred that the closure be provided with a plurality of generally axially extending vent grooves 22, which traverse the thread formation 18. The vent grooves facilitate the flow of gas pressure from a container during closure removal after liner 20 moves out of sealing engagement with the container, but prior to disengagement of thread formation 18 from the container.

In order to provide visually discernable evidence that the closure has been partially or completely removed, closure 10 includes an annular pilfer band 24 depending from the skirt portion 16. Pilfer band 24 can be configured in accordance with the teachings of U.S. Pat. No. 4,418,828, hereby incorporated by reference, and accordingly, includes a generally annular band portion 26 inwardly from which extend a plurality of circumferentially spaced flexible projections 28. Flexible projections 28 each include an edge portion integral with annular band portion 26, which edge portion is disposed at an acute angle relative to the vertical axis of the closure. The projections 28 are configured for interfering engagement and cooperation with the annular locking ring portion of a conventionally configured container.

If desired, pilfer band 24 may be provided with a plurality of backing beads 30, two of which are illustrated in phantom line in FIG. 1, which backing beads are respectively associated with the flexible projections 28. The flexible projections 28, and optional backing beads 30, can be configured in accordance with the teachings of U.S. Pat. No. 5,004,112, hereby incorporated by reference. The projections and backing beads cooperate to promote interfering engagement between the projections and the associated container locking ring when each projection is bent generally downwardly and into engagement with the respective one of the backing beads.

As will be appreciated, the tamper-indicating closure embodying the present invention may be configured for tamper-indication by including a container-engaging arrangement other than the projections 28.

In accordance with the present invention, pilfer band 24 is configured for partial detachment from the skirt portion 16 of the closure cap 12, with the pilfer band remaining joined to the closure skirt portion after such partial detachment. To this end, the closure includes a plurality of circumferentially spaced frangible bridges 32 which extend between the inside surfaces of the skirt portion 16 and the annular band portion 26 of the pilfer band 24. The desired frangible connection between the pilfer band and the skirt portion is further provided by a circumferentially extending score line 34 which extends substantially, but preferably not completely, about the circumference of closure 10. The score line 34 extends through the closure to thereby separate and distinguish the pilfer band 24 from the skirt portion, with the score line extending into the frangible ribs 32 whereby each of the frangible ribs 32 includes an unscored, frangible "residual" portion. Thus, the detachable connection between the pilfer band and the skirt portion is collectively provided by the unscored residual portions of the frangible bridges 32.

The pilfer band 24 remains joined to the skirt portion 16 of the closure cap by a single connector portion 36. In accordance with the illustrated embodiment, the connector portion 36 extends between and is defined by the opposite ends of the circumferential score 34, with the connector portion 36 thus being provided by an unscored portion of the closure. However, it will be appreciated that a relatively strong, non-frangible connector portion could be otherwise provided, such as by providing one or more relatively large non-frangible bridges on the inside surface of the closure, with complete circumferential scoring of the closure.

Figure 2:
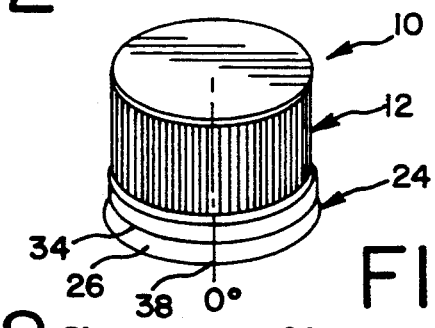
FIG. 2 is a perspective view of the closure illustrated in FIG. 1, illustrating one side thereof.
Figure 3:
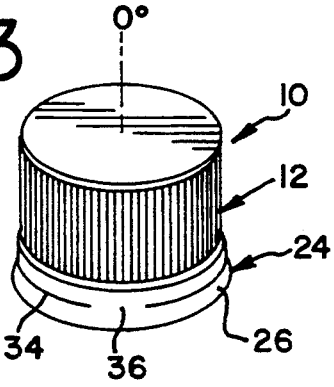
FIG. 3 is a perspective view similar to FIG. 2 showing a diametrically opposed side of the closure.

In accordance with the present invention, the pilfer band 24 is fracturable and detachable in a manner which provides a plurality of band segments which extend from respective opposite sides of the connector portion 36. The pilfer band includes a fracturable region provided by a generally vertical scoring arrangement 38, which region fractures and splits attendant to removal of the closure from a container. As illustrated in FIGS. 2 and 3, wherein the 0° reference line identifies the orientation of the present closure, the generally vertical scoring arrangement 38 is provided in diametrically opposed relationship to the non-frangible connector portion 36.

Figure 2A:
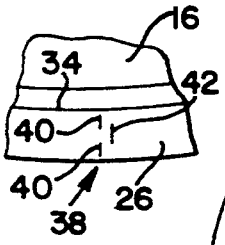
FIG. 2*a* is a relatively enlarged, fragmentary perspective view of the side of the closure shown in FIG. 2.

A preferred form of the generally vertical scoring arrangement 38 is generally illustrated in FIG. 2*a*. The scoring arrangement may be formed in accordance with the teachings of U.S. Pat. No. 4,720,018, to Schetzsle et al., the teachings of which are hereby incorporated by reference, which scoring arrangement has been found to be subject to efficient manufacture and reliable performance. The scoring arrangement 38 includes a pair of vertically spaced and aligned scores 40, between which is defined an unscored, fracturable residual portion of the pilfer band. It is this residual portion which fractures attendant to closure removal, thereby resulting in fracture and splitting of the annular band portion 26 of the pilfer band 24. In the preferred form, the scoring arrangement 38 further includes a secondary or so-called "helper" score 42 generally aligned with, but spaced circumferentially of, the fracturable residual portion defined by scores 40. In accordance with the teachings of the above-referenced patent, formation of the secondary score 42 substantially simultaneously with the formation of vertically spaced scores 40 acts to create a compressive force which precludes undesired propagation of the scores 40 (which can otherwise occur because of the wedge-like action of the scoring knife blades), thus assuring the desired formation of the unfractured residual portion between scores 40.

Figure 4:
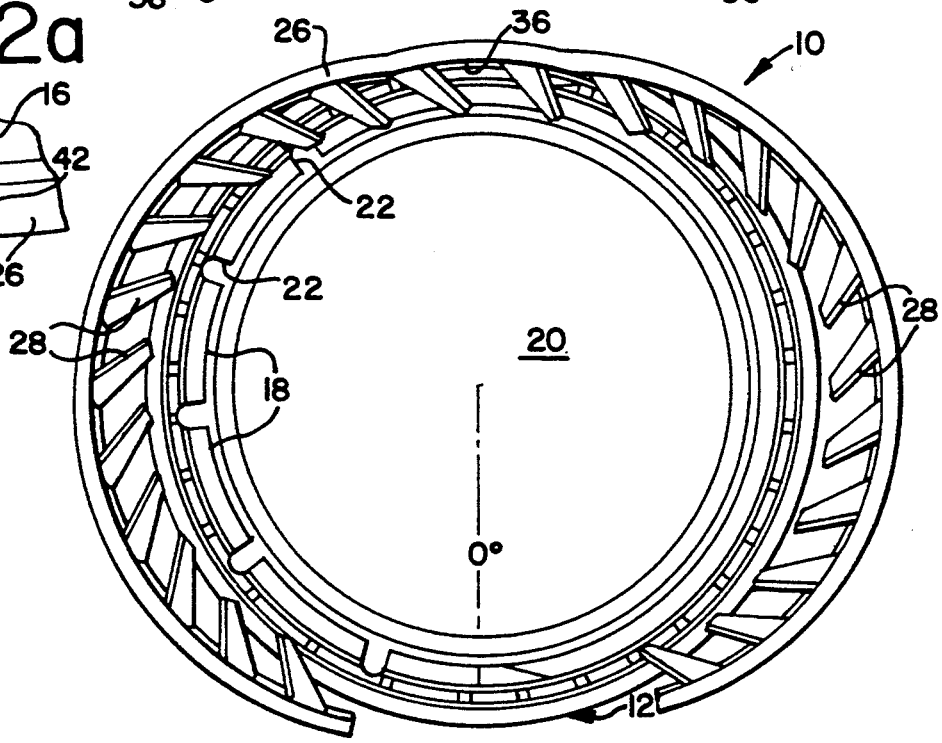
FIG. 4 is a bottom plan view of the present closure, showing a pilfer band thereof, in a partially detached condition.
Figure 5:
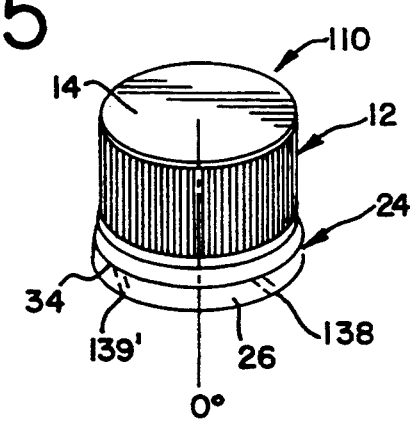
FIG. 5 is a perspective view of one side of an alternate embodiment of the present closure.
Figure 6:
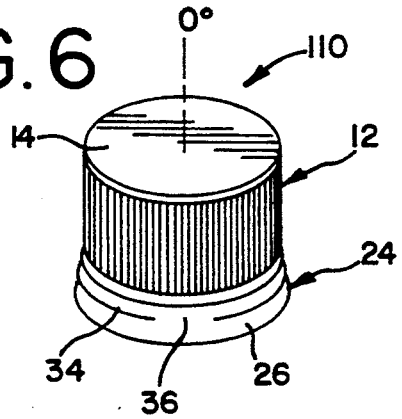
FIG. 6 is a perspective view similar to FIG. 5 showing a diametrically opposed side of the closure.

With further reference to FIGS. 2 and 3, and FIG. 4, it is presently preferred that the connector portion 36 extends between about 10° and 120°, with each of the pilfer band segments extending at least 90° about the circumference of the closure, and no greater than about 180° about the circumference of the closure. In the illustrated embodiment, wherein scoring arrangement 38 is diametrically opposed to connector portion 36, the pilfer band segments are of substantially equal length, with the connector portion 36 extending about 60° in a presently preferred embodiment.

As shown in FIG. 4, fracture of the generally vertical scoring arrangement 38 attendant to closure removal, coupled with fracture of frangible bridges 32, results in the two segments of the pilfer band separating from skirt portion 16 of the closure cap 12, with the segments remaining joined to the closure by connector portion 36. In the event that one or both of the segments are removed by a consumer, and placed in the associated container, the pilfer band segments are of a length which facilitates removal of the segments from the container by typical automatic washing equipment.

With reference now to FIGS. 5–10, therein is illustrated an alternate embodiment of the present tamper-indicating closure, designated 110. In most respects, the closure 110 is like the previously described closure 10, and thus, like reference numerals have been used for such like features.

In distinction from the previous embodiment, closure 110 includes a plurality of fracturable regions in the pilfer band 24, specifically two fracturable generally vertical scoring arrangements, designated 138, 138'. In accordance with the previous arrangement, each of the scoring arrangements 138, 138' preferably comprises a pair of scores between which a fracturable residual portion is defined, as well as a secondary or "helper" score associated with the residual portion. In distinction from the previous embodiment, the scoring arrangements 138, 138' are not truly vertically oriented, but rather are disposed at an acute angle relative to the vertical axis of the closure, which angle corresponds to the angular disposition of the edge portion of each projection 28 which is integral with annular band portion 26. This angular disposition of the scoring arrangements 138, 138' avoids unintended strengthening of the scoring arrangements by reducing the likelihood that one of the scoring arrangements is aligned with one of the projections 28.

The generally vertical scoring arrangements 38, and the scoring arrangements 138, and 138' located at an acute angle relative to the vertical axis of the closure, are both considered as being disposed generally parallel to said vertical axis.

Figure 7:
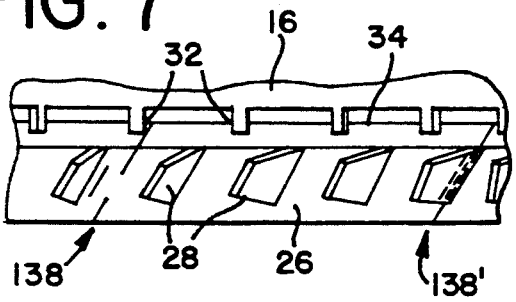
FIG. 7 is a relatively enlarged, fragmentary elevational view of the inside of a pilfer band of the closure shown in FIGS. 5 and 6.
Figure 8:
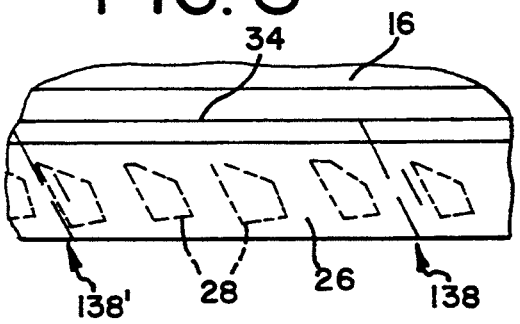
FIG. 8 is a fragmentary elevational view of the outside of the pilfer band shown in FIG. 7.

Since it is desired that at least one of the scoring arrangements 138, 138' fracture as intended, it is further preferred that the pair of scoring arrangements be circumferentially spaced from each other by a distance other than the relative spacing between any two of the projections 28. This is illustrated in FIGS. 7 and 8, wherein the scoring arrangement 138' is shown in substantial alignment with one of the projections 28. By virtue of the relative spacing of the scoring arrangements, it will be observed that scoring arrangement 138 is positioned in an orientation so that it is fracturable as intended.

As will be appreciated, this embodiment of the present closure differs from the previously-described embodiment, in that the pilfer band 24 includes three pilfer band segments, specifically, two band segments which each extend from a respective side of the connector portion 36 to a respective one of the generally vertical scoring arrangements 138, 138' and a third pilfer band segment which is defined by and extends between the fracturable regions defined by the generally vertical scoring arrangements 138, 138'. Preferably, each of the pilfer band segments extends no more than about 100° about the circumference of the closure.

Figure 9:
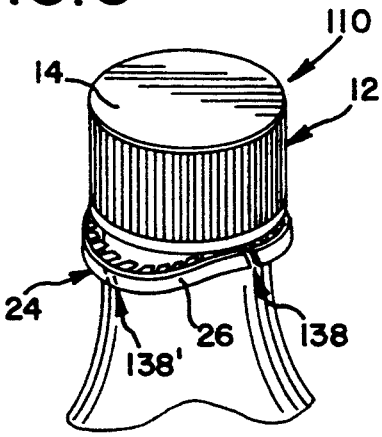
FIGS. 9 and 10 are perspective views illustrating removal of the closure from an associated container, and fracture and partial detachment of the closure pilfer band.
Figure 10:
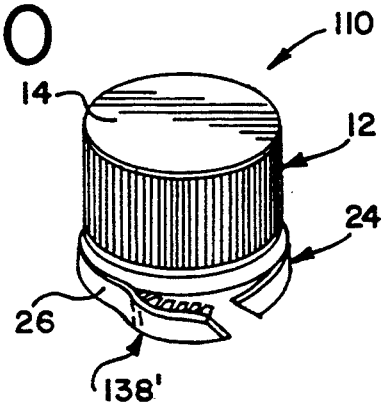

During closure removal, it is contemplated that at least one, but not necessarily both, of the generally vertical scoring arrangements 138, 138' will fracture, resulting in fracture and splitting of the pilfer band 24 while it remains attached to the closure cap 12 by connector portion 36. As shown in FIGS. 9 and 10, the generally vertical scoring arrangement 138 is illustrated as fracturing, while the other generally vertical scoring arrangement 138' can remain intact, with the pilfer band otherwise partially detaching from the closure cap 12. By virtue of the still-existing frangible region at 138', a consumer who pulls the third pilfer band segment (initially defined between vertical scoring 138 and 138') would detach this third segment, again resulting in segments of a length which can be automatically washed from within a container in the event that a consumer inserts them into the container.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A tamper-indicating plastic closure for a container having an annular locking ring, comprising:

a closure cap having a top wall portion, and a depending annular skirt portion depending from said top wall portion and including an internal thread formation for engagement with a like thread formation on said container; and an annular pilfer band partially detachably connected to said skirt portion by a plurality of circumferentially spaced frangible bridges including an annular band portion, and a plurality of circumferentially spaced projections extending inwardly from said annular band portion, said pilfer band being separated and distinguished from said skirt portion by horizontal score means extending partially circumferentially about said closure, said projections being engageable with said container locking ring during removal of said closure from said container for fracturing said frangible bridges, said pilfer band including an unscored connector portion connecting said pilfer band to said skirt portion after fracture of said frangible bridges, said connector portion being defined between ends of said circumferentially extending horizontal score means, said pilfer band including a pair of spaced apart fracturable means, each comprising score means including at least two spaced apart scores defining therebetween a fracturable residual portion of said pilfer band, so that upon removal of said closure from said container and fracture of said frangible bridge means, at least one of said fracturable means fractures by fracture of the residual portion thereof, said pilfer band including a pair of pilfer band segments, each extending circumferentially from said connector portion to a respective one of said pair of fracturable means, each of said band segments extending no more than about 100° about the circumference of said closure, said pilfer band including a third pilfer band segment in substantially diametrically opposed relation to said connector portion and extending between said pair of fracturable means, said third band segment being sufficiently short to permit removal thereof from within said container by an associated automatic washing apparatus.

2. A tamper-indicating plastic closure in accordance with claim 1, wherein said pair of pilfer band segments are of substantially equal length.

3. A tamper-indicating plastic closure in accordance with claim 1, wherein said connector portion extends circumferentially of said closure between about 10°–120°.

4. A tamper-indicating plastic closure in accordance with claim 1, wherein said pair of fracturable means are circumferentially spaced from each other by a distance other than the relative spacing between any two of said projections, to thereby assure that at least one of said pair of fracturable means will fracture upon closure removal.

5. A tamper-indicating plastic closure in accordance with claim 1, wherein each of said pilfer band segments extends no more than about 100° about the circumference of said closure.

6. A tamper-indicating plastic closure in accordance with claim 1, wherein said inwardly extending projections each include an edge portion integral with said annular band portion extending at an acute angle relative to the vertical axis of said closure, each of said score means of said fracturable means being disposed at said acute angle relative to the vertical axis of said closure.

7. A tamper-indicating closure in accordance with claim 1, wherein said two spaced apart scores of the score means of each said fracturable means are vertically spaced apart.

* * * * *